US006062042A

United States Patent [19]

McNeil et al.

[11] Patent Number: 6,062,042

[45] Date of Patent: May 16, 2000

[54] SEPERATION OF CARBON MONOXIDE FROM NITROGEN-CONTAMINATED GASEOUS MIXTURES

[75] Inventors: Brian Alfred McNeil, Chessington; Eric William Scharpf, Walton-on-Thames, both of United Kingdom

[73] Assignee: Air Products and Chemicals, Inc., Allentown, Pa.

[21] Appl. No.: 09/225,068

[22] Filed: Jan. 4, 1999

[30] Foreign Application Priority Data

Jan. 13, 1998 [GB] United Kingdom ..... 9800693

[51] Int. Cl.[7] ..... F25J 1/00

[52] U.S. Cl. ..... 62/625; 62/632; 62/920

[58] Field of Search ..... 62/625, 632, 635, 62/920

[56] References Cited

U.S. PATENT DOCUMENTS

| | | | |
|---|---|---|---|
| 4,311,496 | 1/1982 | Fabian | 62/920 |
| 4,478,621 | 10/1984 | Fabian | 62/31 |
| 5,351,491 | 10/1994 | Fabian | 62/920 |
| 5,351,492 | 10/1994 | Agrawal et al. | 62/920 |
| 5,359,857 | 11/1994 | Honda | 62/920 |

FOREIGN PATENT DOCUMENTS

| | | | |
|---|---|---|---|
| 0676373 A1 | 11/1995 | European Pat. Off. | C01B 31/18 |
| 1954133 A1 | 7/1997 | Germany | C01B 31/18 |

*Primary Examiner*—Ronald Capossela
*Attorney, Agent, or Firm*—Willard Jones II

[57] ABSTRACT

Carbon monoxide is separated from a gaseous mixture containing hydrogen and contaminated with nitrogen by separating hydrogen and carbon monoxide contents to provide a carbon monoxide-enriched nitrogen-containing stream and separating carbon monoxide and nitrogen contents of said stream in a nitrogen-separation column to provide a nitrogen-enriched overheads vapor and a nitrogen-freed bottoms liquid. The overheads vapor is washed with liquid nitrogen to remove carbon monoxide therefrom and the resultant carbon monoxide-enriched liquid nitrogen is returned to said column as additional reflux. The liquid nitrogen wash simultaneously reduces the loss of carbon monoxide with the nitrogen-enriched vapor and provides refrigeration to the process. When the gaseous feed is a synthesis gas also containing methane, the methane and carbon monoxide contents can be separated before or after separation of the nitrogen and carbon monoxide contents.

19 Claims, 6 Drawing Sheets

SEPERATION OF CARBON MONOXIDE FROM NITROGEN-CONTAMINATED GASEOUS MIXTURES

TECHNICAL FIELD OF THE INVENTION

The present invention relates to the separation of carbon monoxide ("CO") from gaseous mixtures containing carbon monoxide and hydrogen and contaminated with nitrogen. It has particular, but not exclusive, application to the separation of carbon monoxide from synthesis gas containing carbon monoxide, hydrogen, methane and nitrogen.

BACKGROUND OF THE INVENTION

Carbon monoxide usually is obtained by separation from synthesis gases produced by catalytic conversion or partial oxidation of natural gas, oils or other hydrocarbon feedstock. In addition to carbon monoxide, these gases contain primarily hydrogen and methane but are often contaminated with significant amounts of nitrogen (derived from the feed or added during processing). Conventional cryogenic separation processing leaves nitrogen as an impurity in the carbon monoxide, which, for both environmental and processing reasons, is unacceptable for some uses of carbon monoxide. The problem of nitrogen contamination of carbon monoxide product is becoming an increasing problem with the usage of more marginal feed stock in front end reforming processes. Accordingly, there is a demand for efficient and effective removal of contaminant nitrogen from carbon monoxide-containing feeds.

Prior art processes for the removal of nitrogen from methane-containing synthesis gas usually include the sequential steps of removing hydrogen from the synthesis gas, removing methane from the resultant hydrogen-freed steam, and removing nitrogen from the resultant hydrogen- and methane-freed stream to leave a purified CO product stream. Usually, at least part of the condensation and reboil duty for one or more of those columns is provided by a recycle carbon monoxide heat pump stream U.S. Pat. No. 4,478,621 discloses such a process for the recovery of carbon monoxide in which synthesis gas feed is partially condensed and the resultant two phase mixture fed to a wash column in which carbon monoxide is scrubbed from the vapor phase by contact with a liquid methane stream to provide CO-loaded methane containing some, typically 3–4%, hydrogen. A CO recycle heat pump stream provides intermediate indirect cooling to the wash column to remove the heat of solution of carbon monoxide in methane. Residual hydrogen is removed from the CO-loaded methane in a stripping column to meet the required carbon monoxide product specification. The hydrogen-stripped CO-loaded methane is separated into nitrogen-contaminated carbon monoxide overheads vapor and methane-rich bottoms liquid in a methane-separation fractionation column in which both overheads cooling and bottoms reboil is indirectly provided by the CO recycle heat pump stream. Nitrogen is removed from the carbon monoxide overheads in a nitrogen/CO fractionation column to provide CO product bottoms liquid. Overheads cooling to the nitrogen/CO fractionation column is indirectly provided by expanded CO product bottoms liquid and bottom reboil is directly provided by the CO recycle heat pump stream.

EP-A-0676373 discloses a similar process for the recovery of carbon monoxide but in which hydrogen is separated from synthesis gas feed by partial condensation. The condensate is separated into nitrogen-contaminated carbon monoxide overheads vapor and methane-rich bottoms liquid in a methane-separation fractionation column. Nitrogen is removed from the carbon monoxide overheads in a nitrogen/CO fractionation column to provide CO product bottoms liquid. Partial condensation of overheads from at least one of said fractionation columns and bottoms reboil to the nitrogen/CO fractionation column are provided by a CO recycle heat pump stream. In one embodiment (FIG. 5), CO product bottoms liquid from the nitrogen/CO fractionation column is further distilled in an argon/CO fractionation column to provide argon-freed CO overheads vapor and an argon-enriched bottoms liquid. Bottoms reboil for the argon/CO fractionation column also is provided by the CO recycle heat pump stream.

The stated characterising feature of the process of EP-A-0676373 is reduction of energy consumption and plant capital cost by providing overheads condensation for only one of said separation columns and refluxing the other of said columns with liquid extracted at an intermediate location of the said column having overheads condensation. However, it does describe a process (FIG. 2) which does not have said reflux feature but partially condenses overheads of both the methane- and nitrogen-separation columns.

DE-A-19541339 discloses a process for removing nitrogen from synthesis gas in which the synthesis gas feed is partially condensed and hydrogen is removed from the condensed fraction in a stripping column to provide a hydrogen-freed CO-rich liquid. Nitrogen is separated from said CO-rich liquid in a nitrogen-separation fractionation column to provide a nitrogen-freed CO-rich bottoms liquid. Part of said nitrogen-freed CO-rich bottoms liquid is vaporized and both the vaporized and remaining (liquid) portions are fed to a methane-separation fractionation column to provide CO product overheads vapor and methane bottoms liquid. Optionally, additional CO is recovered from the hydrogen-rich vapor portion of said partial condensation of the synthesis gas feed by, for example, pressure swing adsorption or membrane separation and processing of the flush gas or membrane retentate.

Reboil to all three columns of DE-A-19541339 is provided by vaporizing a portion of the respective bottoms liquid and returning the vaporized portion to the relevant column. In one embodiment (FIG. 1), heat duty for the reboil of all three columns and condensation duty for reflux of the nitrogen-separation column is provided by a CO recycle heat pump stream, which also directly provides reflux to the methane-separation column. In remaining embodiments (FIGS. 2 & 3), heat duty for the reboil of all three columns and condensation duty for reflux of both the nitrogen- and methane-separation columns is provided by a (nitrogen) closed circuit heat pump stream.

It is an object of the present invention to provide a more cost effective process for separating carbon monoxide from gaseous mixtures containing carbon monoxide and hydrogen and contaminated with nitrogen, especially those which also contain methane.

SUMMARY OF THE INVENTION

It has been found that capital costs and/or the power consumption required to separate carbon monoxide from gaseous mixtures containing carbon monoxide and hydrogen and contaminated with nitrogen can be reduced and/or the recovery of carbon monoxide increased by washing overheads vapor from the nitrogen/CO-separation column with liquid nitrogen and returning the resultant carbon monoxide-enriched liquid nitrogen to said column as additional reflux. There are additional energy requirements to remove the added nitrogen and additional capital cost in providing the wash column but these are more than compensated for by capital cost and/or energy saving resultant from increased nitrogen content of the reflux to the nitrogen/CO-separation and the provision of cold refrigeration by the liquid nitrogen. In particular, process stream expansion to provide refrigeration can be obviated or at least reduced, carbon monoxide recovery can be increased and/or hydrogen product pressure can be increased (obviating or at least reducing the need for compressing the hydrogen product for downstream processing).

Thus, according to a first general aspect, the present invention provides a process for separating carbon monoxide from a gaseous mixture containing carbon monoxide and hydrogen and contaminated with nitrogen comprising separating hydrogen and carbon monoxide contents to provide a carbon monoxide-enriched nitrogen-containing stream and separating carbon monoxide and nitrogen contents of said stream in a nitrogen-distillation column to provide a nitrogen-enriched overheads vapor and a nitrogen-freed bottoms liquid, characterized in that said overheads vapor is washed with liquid nitrogen to remove carbon monoxide therefrom and the resultant carbon monoxide-enriched liquid nitrogen returned to said column to contribute to reflux thereof. Having regard to the typical level of nitrogen contamination in synthesis gas (on the order of 1%), the carbon monoxide-enriched liquid nitrogen returned to the nitrogen-distillation column will contribute less than about 5% of the total reflux in the column.

In a second general aspect, the invention provides an apparatus for separating carbon monoxide from a gaseous mixture containing carbon monoxide and hydrogen and contaminated with nitrogen, said apparatus comprising a separating means for separating hydrogen and carbon monoxide contents to provide a carbon monoxide-enriched nitrogen-containing stream; nitrogen-distillation column for separating nitrogen content from carbon monoxide content of said stream to provide a nitrogen-enriched overheads vapor and a nitrogen-freed bottoms liquid; a wash column; conduit means for feeding said overheads vapor to the wash column; conduit means for feeding liquid nitrogen to the wash column to wash carbon monoxide from said vapor and thereby provide carbon monoxide-enriched liquid nitrogen; and conduit means for feeding said carbon monoxide-enriched liquid nitrogen to the nitrogen-separation column as additional reflux.

DETAILED DESCRIPTION OF THE INVENTION

Figure 1:
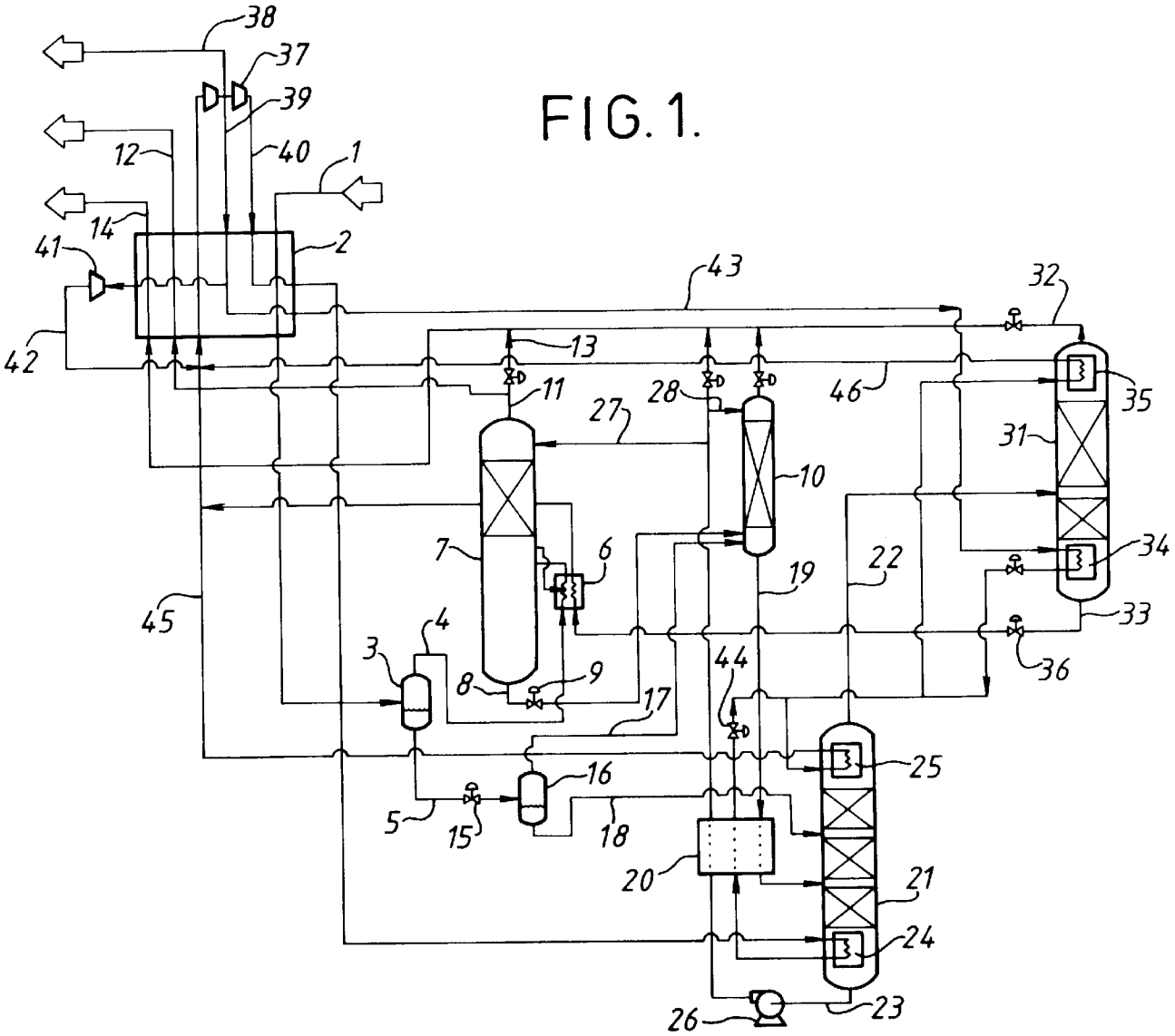
FIG. 1 is a schematic representation of an essentially conventional process for separating carbon monoxide from a synthesis gas containing carbon monoxide, hydrogen, methane and nitrogen.

The present invention provides an improvement in a process for separating carbon monoxide from a gaseous mixture containing carbon monoxide and hydrogen and contaminated with nitrogen in which, after separation of hydrogen content, carbon monoxide and nitrogen contents are separated in a nitrogen-separation column to provide a nitrogen-enriched overheads vapor and a nitrogen-freed bottoms liquid. The improvement is washing the nitrogen-enriched overheads vapor with liquid nitrogen to remove carbon monoxide therefrom and returning the resultant carbon monoxide-enriched liquid nitrogen to said column as additional reflux.

The present invention correspondingly provides an improvement in an apparatus for separating carbon monoxide from a gaseous mixture containing carbon monoxide and hydrogen and contaminated with nitrogen and comprising a nitrogen-separation column for separating nitrogen content from carbon monoxide content from a hydrogen-freed stream to provide a nitrogen-enriched overheads vapor and a nitrogen-freed bottoms liquid. The improvement is that the apparatus includes a wash column, conduit means for feeding said overheads vapor to the wash column, conduit means for feeding liquid nitrogen to the wash column to wash carbon monoxide from said vapor and thereby provide carbon monoxide-enriched liquid nitrogen, and conduit means for feeding said carbon monoxide-enriched liquid nitrogen to the nitrogen-separation column as additional reflux.

In a first general aspect, the present invention, provides an improved cryogenic process for separating carbon monoxide from a gaseous mixture containing carbon monoxide and hydrogen and contaminated with nitrogen comprising separating hydrogen and carbon monoxide contents to provide a carbon monoxide-enriched nitrogen-containing stream and separating carbon monoxide and nitrogen contents of said stream in a nitrogen-distillation column to provide a nitrogen-enriched overheads vapor and a nitrogen-freed bottoms liquid, the improvement consisting in that said overheads vapor is washed with liquid nitrogen to remove carbon monoxide therefrom and the resultant carbon monoxide-enriched liquid nitrogen returned to said column to contribute to reflux thereof.

In a second general aspect, the invention provides an apparatus for separating carbon monoxide from a gaseous mixture containing carbon monoxide and hydrogen and contaminated with nitrogen, said apparatus comprising a separator constructed and arranged to separate hydrogen and carbon monoxide contents to provide a carbon monoxide-enriched nitrogen-containing stream; a nitrogen-distillation column for separating nitrogen content from carbon monoxide content of said stream to provide a nitrogen-enriched overheads vapor and a nitrogen-freed bottoms liquid; a wash column; a conduit constructed and arranged to feed said overheads vapor to the wash column; a conduit constructed and arranged to feed liquid nitrogen to the wash column to wash carbon monoxide from said vapor and thereby provide carbon monoxide-enriched liquid nitrogen; and a conduit constructed and arranged to feed said carbon monoxide-enriched liquid nitrogen to the nitrogen-separation column as additional reflux.

The liquid nitrogen wash simultaneously reduces the loss of carbon monoxide with the nitrogen-enriched vapor and provides refrigeration to the process. When the process employs a conventional recycle carbon monoxide heat pump stream, this refrigeration enables the recycle system to be simplified by, for example, elimination of a recycle expander. Further, the present invention facilitates the provision of high pressure hydrogen and/or reduction in the complexity, and possible elimination, of a hydrogen stripper unit.

The liquid nitrogen-wash column can be provided as a discrete column but usually will be provided as a top hat portion to the nitrogen-separation column.

Usually, the process of the present invention will comprise the steps of separating hydrogen and carbon monoxide contents; subsequently separating nitrogen and carbon monoxide contents in a distillation column to provide nitrogen-freed carbon monoxide bottoms liquid and nitrogen-enriched overheads vapor; before or after said nitrogen distillation, separating methane and carbon monoxide contents in a distillation column to provide methane-enriched liquid bottoms and methane-freed carbon monoxide overheads vapor; washing said nitrogen-enriched overheads vapor with liquid nitrogen to remove carbon monoxide therefrom and thereby provide carbon monoxide-enriched liquid nitrogen; and returning said carbon monoxide-enriched liquid nitrogen to the nitrogen-separation column as reflux.

Conventionally, the nitrogen distillation is conducted downstream of (i.e. after) the methane separation and separates the nitrogen and carbon monoxide contents of said methane-freed carbon monoxide overheads vapor. However, as taught in DE-A-19541339 and our co-pending U.S. patent application Ser. No. 09/224,690 filed Jan. 4, 1999, it is preferred that the methane separation occurs downstream of the nitrogen distillation and separates the methane and carbon monoxide contents of said nitrogen-freed carbon monoxide bottoms liquid. The teaching of DE-A-19541339 and our co-pending application are incorporated herein by the references thereto.

Conveniently, the separation of hydrogen and carbon monoxide contents comprises partially condensing the gaseous mixture to provide a hydrogen-enriched vapor feed fraction and a carbon monoxide-enriched liquid feed fraction. Preferably, hydrogen is stripped from the carbon monoxide-enriched liquid feed fraction to provide a hydrogen-rich vapor fraction and a hydrogen-freed liquid fraction.

The hydrogen-enriched vapor feed fraction can be partially condensed by heat exchange against one or more process streams and at least a portion of the resultant condensed vapor feed fed to the hydrogen stripping step to augment the carbon monoxide-enriched liquid feed fraction and/or at least a portion of the resultant condensed vapor feed is recycled to the partial condensation step. At least a portion of the hydrogen-rich vapor fraction can be recycled to the partial condensation step.

Alternatively, the hydrogen-enriched vapor feed portion can be washed with liquid methane to remove carbon monoxide therefrom to form a carbon monoxide-enriched liquid which is fed to the hydrogen stripping step to augment the carbon monoxide-enriched liquid feed fraction.

In accordance with prior art practice, a recycle carbon monoxide heat pump stream usually will provide reboil or condensation duty to at least one of the nitrogen-separation and methane-separation columns. Suitably, the recycle carbon monoxide heat pump stream provides reboil and condensation duty to the methane-separation column and to the nitrogen-separation column.

Figure 3:
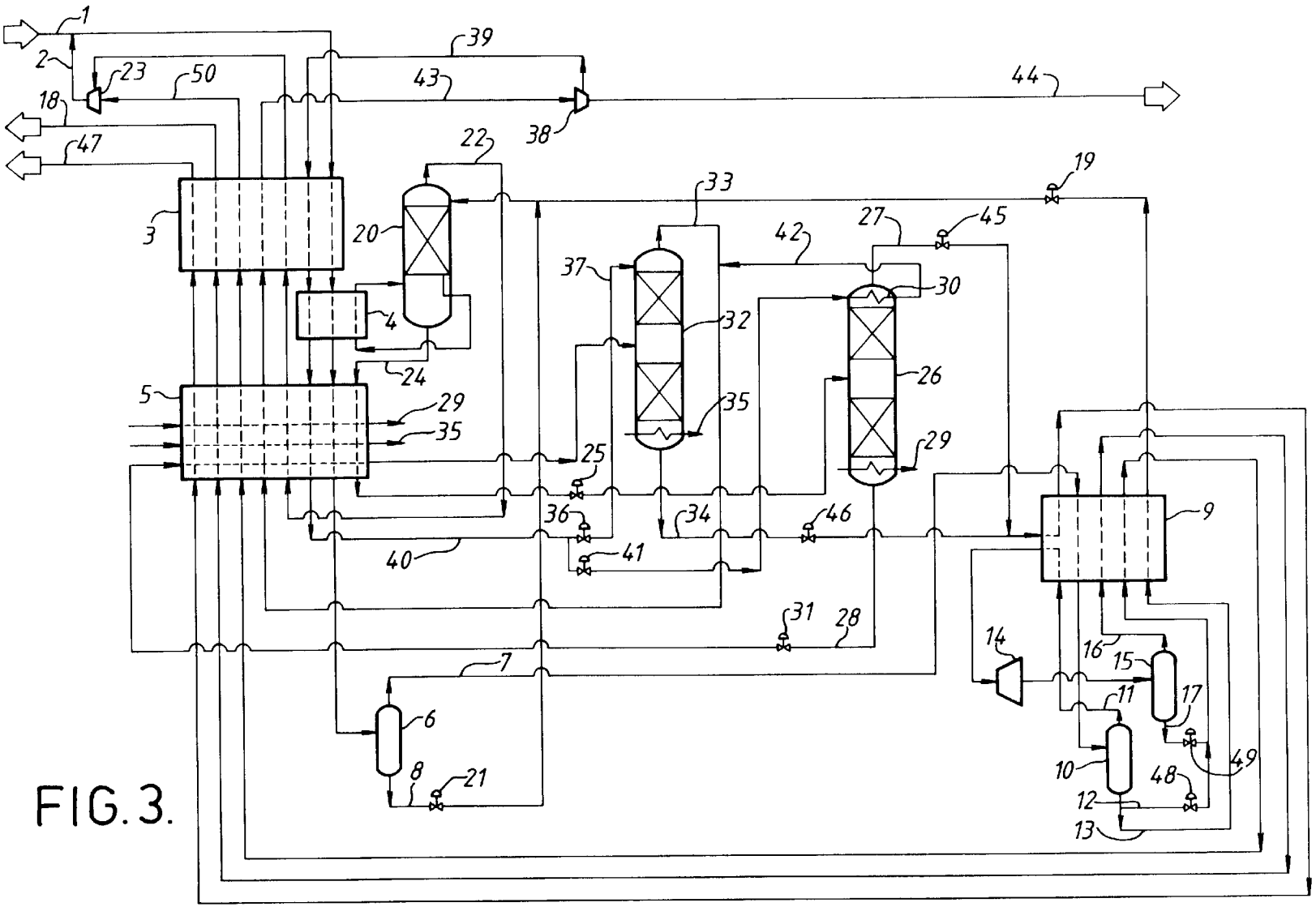
FIG. 3 is a schematic representation of a process for separating carbon monoxide from a synthesis gas containing carbon monoxide, hydrogen, methane and nitrogen incorporating the teaching of DE-A-19541339.
Figure 4:
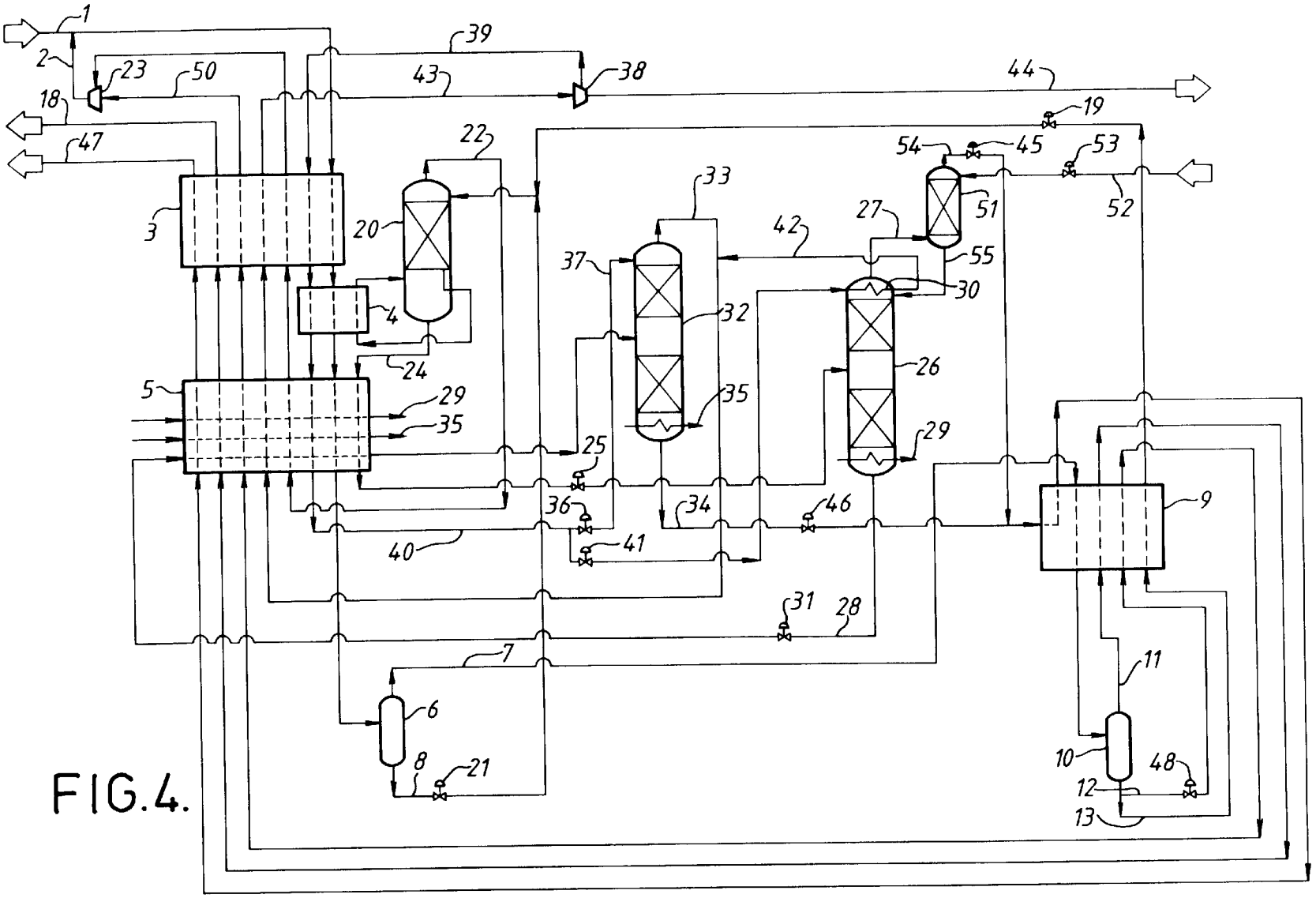
FIG. 4 is a schematic representation of a modification of the process of FIG. 3 incorporating a liquid nitrogen-wash column in accordance with the present invention.

The following is a description, by way of example only and with reference to the accompanying drawings, of presently preferred embodiments of the present invention. Common features in each pair of figures (FIGS. 1 & 2; FIGS. 3 & 4; & FIGS. 5 & 6) are identified by the same reference numerals but there is no correlation between the reference numerals of one pair with any other pair.

Referring first to FIG. 1, crude synthesis gas is introduced via conduit 1, cooled and partially condensed in heat exchanger 2. The partially condensed mixture is separated in separator 3 to provide hydrogen-enriched vapor and carbon monoxide-enriched liquid fractions in conduits 4 and 5 respectively. The vapor in conduit 4 is partially condensed in heat exchanger 6 against bottoms liquid from nitrogen-separation column 31 and fed to methane wash column 7, where it is washed with liquid methane reflux supplied via conduit 27 from the methane-separation column 21 to dissolve carbon monoxide in the vapor into a bottoms liquid. Alternatively, the vapor in conduit 4 is fed to the bottom of the methane wash column 7. The bottoms liquid is removed in conduit 8 and, after reduction in pressure by control valve 9, is fed to hydrogen scrub column 10. Heat of solution of carbon monoxide in methane is removed from column 7 by heat exchanger 6.

Overheads vapor from the methane wash column 7 is removed in conduit 11, warmed in heat exchanger 2, and leaves the plant as hydrogen-rich product in conduit 12. This may be further processed, for example in pressure swing adsorbers, to provide a pure hydrogen product. Excess overheads vapor from column 7 is fed via conduit 13 to mix with other streams as described below and warmed to provide fuel gas in conduit 14.

The carbon monoxide-enriched liquid fraction in conduit 5 from the feed separator 3 is partially vaporized by reduction in pressure by control valve 15 and separated in separator 16 into vapor and liquid fractions in conduits 17 and 18 respectively. The vapor fraction in conduit 17 is introduced into hydrogen scrub column 10 typically at the same point as the bottoms liquid in conduit 8 from the wash column 7.

Reflux duty is provided to hydrogen scrub column 10 by liquid methane supplied via conduit 28 from the methane-separation column 21. Carbon monoxide is recovered as the vapor derived from the feeds from conduits 8 and 17 passes over trays or packing in column 10. Bottoms liquid is removed from column 10 in conduit 19, partially vaporized in heat exchanger 20, and introduced into methane-separation column 21.

Liquid fraction 18 from separator 16 is introduced into methane-separation column 21 several stages above introduction of the partially vaporized hydrogen stripped bottoms liquid in conduit 19. These feeds are separated in column 21 into a methane-freed overheads vapor removed in conduit 22, and a methane-enriched bottoms liquid removed in conduit 23. Column 21 is reboiled by bottom reboiler 24 and reflux is provided by top condenser 25. Both reboiler and condensation duty for column 21 is provided by indirect heat exchange with a recycle carbon monoxide heat pump stream as described below.

Bottoms liquid in conduit 23 is pumped by pump 26, subcooled in heat exchanger 20 and split into two streams.

The first stream in conduit 27 provides the methane wash liquid to column 7. The second stream is further divided into two substreams, one in conduit 28 to provide the reflux to hydrogen scrub column 10 and the second to contribute excess bottoms liquid to the fuel gas 14. Excess overheads vapor in conduit 13 from wash column 7, overheads vapor in conduit 30 from hydrogen scrub column 10 and overheads vapor in conduit 32 from nitrogen-separation column 31 make up the balance of fuel gas 14.

Overheads vapor from column 21 is fed via conduit 22 to nitrogen-separation column 31 where it is separated into nitrogen-rich overheads vapor removed in conduit 32 and carbon monoxide bottoms liquid removed in conduit 33. Column 31 is reboiled by bottom reboiler 34 and reflux is provided by top condenser 35. Both reboiler and condensation duty for column 31 is provided by indirect heat exchange with a recycle carbon monoxide heat pump stream as described below.

Nitrogen-separation bottoms liquid in conduit 33 is reduced in pressure by control valve 36, warmed by heat exchange in heat exchanger 6 and mixed with recycle carbon monoxide streams in conduits 42, 45 and 46. The combined carbon monoxide stream is warmed in heat exchanger 2 and fed to the suction side of heat pump stream compressor 37. Product carbon monoxide is withdrawn from an intermediate stage of compressor 37 and removed from the plant in conduit 38. An intermediate pressure recycle stream also is withdrawn, via conduit 39, from the intermediate stage of compressor 37 and a high pressure recycle stream is withdrawn, via conduit 40, from the final stage of the compressor 37.

The intermediate pressure recycle stream in conduit 42 is cooled in heat exchanger 2 and divided into two substreams. One substream is expanded in expander 41 and returned via conduit 42 to mix with vaporized bottoms liquid from nitrogen-separation column 31 and the other recycle heat pump streams in conduits 45 and 46. The other substream is further cooled in heat exchanger 2 and fed, via conduit 43, to be condensed in nitrogen-separation column reboiler 34.

The high pressure recycle stream in conduit 40 is cooled in heat exchanger 2 and fed to the methane-separation column reboiler 24. The condensed high pressure stream leaving reboiler 24 is subcooled in heat exchanger 20, let down in pressure by control valve 44 and divided into two substreams. One substream is fed to the methane-separation column condenser 25 and the other is mixed with the condensed intermediate pressure stream exiting reboiler 34 and fed to the nitrogen-separation column condenser 35. The vaporized heat pump streams leave the condensers 25 and 35 in conduits 45 and 46 respectively and are mixed with other recycle streams to provide the combined stream rewarmed in heat exchanger 2 prior to feeding to the suction end of compressor 37.

Figure 2:
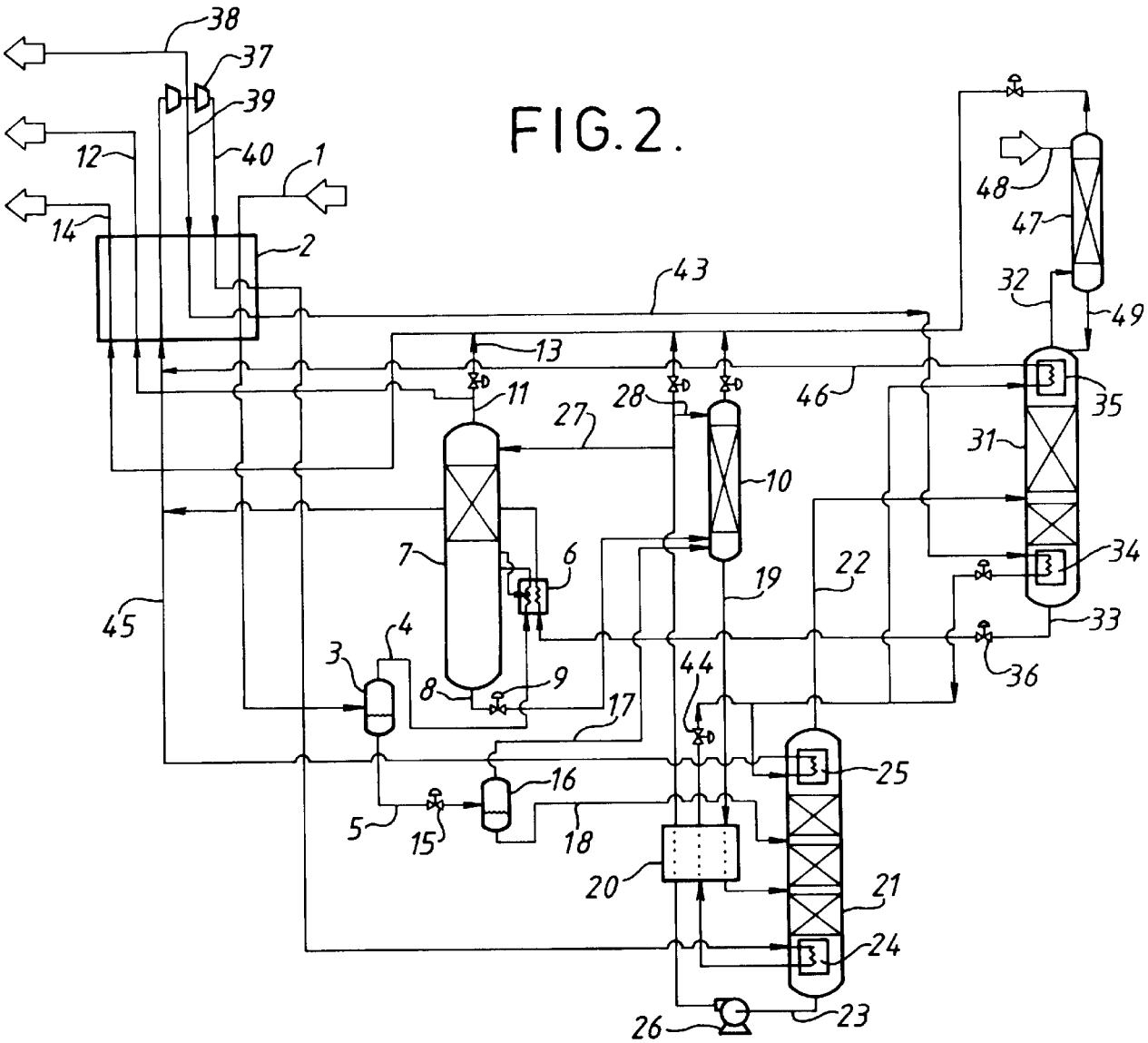
FIG. 2 is a schematic representation of a modification of the process of FIG. 1 incorporating a liquid nitrogen-wash column in accordance with the present invention.

FIG. 2 illustrates an embodiment of the invention which is derived from the process of FIG. 1. Features common with FIG. 1 are identified by the same reference numerals and only the differences between the two processes will be described.

The recycle expander 41 of FIG. 1 is omitted from the process of FIG. 2 and the entire vapor in conduit 39 is cooled in heat exchanger 2 and fed to nitrogen-separation column reboiler 34.

The nitrogen-enriched vapor overheads in conduit 32 from the top of the nitrogen-separation column 31 is introduced into column 47 having trays or packing and washed with liquid nitrogen introduced via conduit 48. The carbon monoxide-enriched bottoms liquid from column 47 is returned to the nitrogen distillation column via conduit 49 as reflux.

The provision of column 47 not only provides the refrigeration requirement provided by expander 41 in FIG. 1 but also recovers carbon monoxide from the vapor overheads as it rises through column 47.

Referring now to FIG. 3, crude synthesis gas is introduced via conduit 1 and mixed with recycle gas in conduit 2. The mixture is cooled in heat exchanger 3 and reboiler 4, and then further cooled and partially condensed in heat exchanger 5. The resultant partially condensed mixture is separated in separator 6 to provide a hydrogen-enriched vapor feed fraction and a carbon monoxide-enriched liquid feed fraction in conduits 7 and 8 respectively.

Vapor in conduit 7 is further partially condensed in heat exchanger 9 and separated in separator 10 into vapor and liquid fractions. The vapor fraction is removed from separator 10 via conduit 11, warmed in heat exchanger 9, expanded in turbine 14, and then separated in separator 15 into vapor and liquid fractions. This vapor fraction is removed from separator 15 via conduit 16, warmed in heat exchangers 9, 5, and 3, and leaves the plant as hydrogen-rich product in conduit 18. This hydrogen-rich product is compressed for further processing, for example in pressure swing adsorbers, to provide a pure hydrogen product.

The liquid fraction from separator 10 is divided in conduits 12 and 13. Liquid in conduit 13 is warmed in heat exchanger 9, reduced in pressure by control valve 19, and introduced into hydrogen stripping column 20. Liquid in conduit 12 is reduced in pressure by control valve 48, mixed with liquid in conduit 17 which has been reduced in pressure by control valve 49, the combined stream vaporized in heat exchanger 9, warmed in heat exchangers 5 and 3, then delivered to the suction of recycle compressor 23 via conduit 50.

Liquid in conduit 8 is reduced in pressure by control valve 21 and also introduced into hydrogen stripping column 20.

Hydrogen stripping column 20 consists of trays or packing where hydrogen is stripped from the liquid feed. Reboiler 4 at the bottom of the column 20 provides stripping vapor for the liquid feed. Vapor overheads leaves from the top of the column in conduit 22 and is warmed in heat exchangers 5 and 3 and then compressed to feed pressure in recycle compressor 23.

Hydrogen-freed liquid bottoms of the hydrogen stripping column 20 is removed in conduit 24, subcooled in heat exchanger 5, reduced in pressure by control valve 25, and introduced into nitrogen-separation column 26. The hydrogen-freed liquid bottoms is separated in the separation column 26 into a nitrogen-enriched vapor overheads in conduit 27, and a carbon monoxide-enriched liquid bottoms in conduit 28. The column 26 is reboiled by reboiler 29 and reflux is provided by condenser 30. Reboiler duty is accomplished by indirect heat exchange with a recycle carbon monoxide heat pump stream and the feed gas mixture in heat exchanger 5.

The carbon monoxide-enriched liquid bottoms in conduit 28 is reduced in pressure by control valve 31, vaporized in heat exchanger 5, and introduced into methane-separation column 32. The vapor is separated in column 32 into a methane-freed carbon monoxide rich vapor overheads in conduit 33, and an argon- and methane-rich liquid bottoms in conduit 34. The column 32 is reboiled by reboiler 35 and reflux is provided by direct introduction of liquid recycle carbon monoxide via control valve 36 and conduit 37.

Reboiler duty is accomplished by indirect heat exchange with the recycle carbon monoxide heat pump stream and the feed gas mixture in heat exchanger 5.

The recycle carbon monoxide heat pump stream is provided from compressor 38 via conduit 39. This stream is cooled in heat exchanger 3 and reboiler 4, and then further cooled and condensed in heat exchanger 5. The condensed heat pump stream in conduit 40 is divided and reduced in pressure by control valves 36 and 41 to provide reflux for column 32, and condenser duty for column 26 by indirect heat exchange in condenser 30. The vaporized carbon monoxide heat pump stream from condenser 30 is mixed with the methane-freed carbon monoxide rich stream in conduit 33 via conduit 42. The combined stream is warmed in heat exchangers 5 and 3, and delivered to compressor 38 via conduit 43. A portion of the compressed stream is removed via conduit 44 to provide the carbon monoxide product stream.

The nitrogen-enriched vapor overheads in conduit 27 and the argon- and methane-rich liquid bottoms in conduit 34 are reduced in pressure by control valves 45 and 46 respectively, mixed, vaporized in heat exchanger 9, then warmed in heat exchangers 5 and 3 to be delivered as fuel gas in conduit 47.

Table 1 summarizes a mass balance for a typical application of the embodiment of FIG. 3.

TABLE 1

(FIG. 3)

(Part 1 of 3)

| Stream | 1 | 2 | 7 | 8 | 11 | 12 | 13 | 16 |
|---|---|---|---|---|---|---|---|---|
| Pressure | | | | | | | | |
| bar abs | 60 | 60 | 59 | 59 | 59 | 59 | 59 | 32 |
| kPa | 6000 | 6000 | 5900 | 5900 | 5900 | 5900 | 5900 | 3200 |
| Temperature deg C. | 10 | 30 | −171 | −171 | −190 | −190 | −190 | −194 |
| Flowrate kgm/h | 2000 | 360 | 1080 | 1280 | 880 | 20 | 190 | 860 |
| Hydrogen mol % | 40.9 | 61.5 | 77.8 | 15.3 | 93.4 | 12.5 | 12.5 | 95.0 |
| Nitrogen mol % | 0.8 | 0.7 | 0.4 | 1.2 | 0.2 | 1.4 | 1.4 | 0.2 |
| Carbon monoxide mol % | 56.9 | 37.1 | 21.4 | 81.3 | 6.4 | 84.4 | 84.4 | 4.8 |
| Argon mol % | 1.3 | 0.6 | 0.4 | 1.7 | 0.1 | 1.5 | 1.5 | 0.1 |
| Methane mol % | 0.3 | 0.0 | 0.0 | 0.5 | 0.0 | 0.2 | 0.2 | 0.0 |
| Vapor fraction | 1 | 1 | 1 | 0 | 1 | 0 | 0 | 1 |

(Part 2 of 3)

| Stream | 17 | 18 | 22 | 24 | 27 | 28 | 33 | 34 |
|---|---|---|---|---|---|---|---|---|
| Pressure | | | | | | | | |
| bar abs | 32 | 31 | 27 | 27 | 8 | 8 | 6 | 6 |
| kPa | 3200 | 3100 | 2700 | 2700 | 800 | 800 | 600 | 600 |
| Temperature deg C. | −194 | 23 | −171 | −146 | −171 | −168 | −172 | −166 |
| Flowrate kgm/h | 20 | 860 | 320 | 1140 | 20 | 1120 | 4100 | 40 |
| Hydrogen mol % | 6.4 | 95.0 | 67.8 | 0.0 | 1.0 | 0.0 | 0.0 | 0.0 |
| Nitrogen mol % | 1.6 | 0.2 | 0.6 | 1.4 | 47.3 | 0.5 | 0.5 | 0.0 |
| Carbon monoxide mol % | 90.4 | 4.8 | 31.1 | 96.0 | 51.6 | 96.8 | 99.0 | 33.0 |
| Argon mol % | 1.6 | 0.1 | 0.5 | 2.0 | 0.0 | 2.1 | 0.5 | 49.0 |
| Methane | 0.1 | 0.0 | 0.0 | 0.6 | 0.0 | 0.6 | 0.0 | 18.0 |
| Vapor fraction | 0 | 1 | 1 | 0 | 1 | 0 | 1 | 0 |

TABLE 1-continued (FIG. 3)

(Part 3 of 3)

| Stream | 37 | 39 | 40 | 42 | 43 | 44 | 47 | 50 |
|---|---|---|---|---|---|---|---|---|
| Pressure | | | | | | | | |
| bar abs | 6 | 9 | 8 | 6 | 6 | 36 | 1.5 | 2 |
| kPa | 600 | 900 | 800 | 600 | 600 | 3600 | 150 | 200 |
| Temperature deg C. | −172 | 32 | −171 | −172 | 23 | 32 | 23 | 23 |
| Flowrate kgm/h | 3020 | 4880 | 4880 | 1860 | 5960 | 1070 | 60 | 40 |
| Hydrogen mol % | 0.0 | 0.0 | 0.0 | 0.0 | 0.0 | 0.0 | 0.4 | 9.9 |
| Nitrogen mol % | 0.5 | 0.5 | 0.5 | 0.5 | 0.5 | 0.5 | 17.3 | 1.5 |
| Carbon monoxide mol % | 99.0 | 99.0 | 99.0 | 99.0 | 99.0 | 99.0 | 39.9 | 86.9 |
| Argon mol % | 0.5 | 0.5 | 0.5 | 0.5 | 0.5 | 0.5 | 31.1 | 1.5 |
| Methane mol % | 0.0 | 0.0 | 0.0 | 0.0 | 0.0 | 0.0 | 11.4 | 0.1 |
| Vapor fraction | 0.008 | 1 | 0 | 1 | 1 | 1 | 1 | 1 |

FIG. 4 illustrates an embodiment of the invention which is derived from the process of FIG. 3. Features common with the embodiment of FIG. 3 are identified by the same reference numerals and only the differences between the two embodiments will be described.

The hydrogen expander 14 and phase separator 15 of the embodiment of FIG. 3 are omitted from the embodiment of FIG. 4 and the entire vapor in conduit 11 is warmed in heat exchangers 9, 5 and 3, and leaves the plant as hydrogen rich product in conduit 18. The pressure of this product is sufficiently high that compression usually is not required prior to further processing.

The nitrogen-enriched vapor overheads in conduit 27 from the top of the nitrogen-separation column 26 is introduced to column 51 having trays or packing and refluxed with liquid nitrogen introduced via conduit 52 and control valve 53. This not only provides the refrigeration requirement provided by expander 14 in FIG. 3 but also recovers carbon monoxide from the vapor overheads as it rises through the column 51.

Table 2 summarizes a mass balance for a typical application of the embodiment of FIG. 4.

TABLE 2

(FIG. 4)

(Part 1 of 3)

| Stream | 1 | 2 | 7 | 8 | 11 | 12 | 13 | 18 |
|---|---|---|---|---|---|---|---|---|
| Pressure | | | | | | | | |
| bar abs | 60 | 60 | 59 | 59 | 59 | 59 | 59 | 59 |
| kPa | 600 | 600 | 590 | 590 | 590 | 590 | 590 | 590 |
| Temperature deg C. | 10 | 32 | −171 | −171 | −190 | −190 | −190 | 23 |
| Flowrate kgm/h | 2000 | 420 | 1080 | 1340 | 870 | 100 | 110 | 870 |
| Hydrogen mol % | 40.9 | 54.6 | 77.8 | 15.3 | 93.4 | 12.5 | 12.5 | 93.4 |
| Nitrogen mol % | 0.8 | 0.8 | 0.4 | 1.2 | 0.2 | 1.4 | 1.4 | 0.2 |
| Carbon monoxide mol % | 56.8 | 43.8 | 21.4 | 81.3 | 6.4 | 84.4 | 84.4 | 6.4 |
| Argon mol % | 1.2 | 0.7 | 0.4 | 1.7 | 0.1 | 1.5 | 1.5 | 0.1 |
| Methane mol % | 0.3 | 0.1 | 0.0 | 0.5 | 0.0 | 0.2 | 0.2 | 0.0 |
| Vapor fraction | 1 | 1 | 1 | 0 | 1 | 0 | 0 | 1 |

(Part 2 of 3)

| Stream | 22 | 24 | 27 | 28 | 33 | 34 | 37 | 39 |
|---|---|---|---|---|---|---|---|---|
| Pressure | | | | | | | | |
| bar abs | 27 | 27 | 8 | 8 | 6 | 6 | 6 | 9 |
| kPa | 270 | 270 | 800 | 800 | 600 | 600 | 600 | 900 |
| Temperature deg C. | −171 | −146 | −171 | −168 | −172 | −166 | −172 | 32 |
| Flowrate kgm/h | 320 | 1120 | 40 | 1110 | 4050 | 40 | 2980 | 4810 |
| Hydrogen mol % | 67.6 | 0.0 | 0.6 | 0.0 | 0.0 | 0.0 | 0.0 | 0.0 |
| Nitrogen mol % | 0.6 | 1.4 | 49.1 | 0.5 | 0.5 | 0.0 | 0.5 | 0.5 |
| Carbon monoxide mol % | 31.2 | 96.0 | 50.3 | 96.8 | 99.0 | 33.2 | 99.0 | 99.0 |
| Argon mol % | 0.5 | 2.0 | 0.0 | 2.1 | 0.5 | 48.7 | 0.5 | 0.5 |
| Methane mol % | 0.0 | 0.6 | 0.0 | 0.6 | 0.0 | 18.0 | 0.0 | 0.0 |
| Vapor fraction | 1 | 0 | 1 | 0 | 1 | 0 | 0.008 | 1 |

(Part 3 of 3)

| Stream | 40 | 42 | 43 | 44 | 47 | 50 | 52 | 54 | 55 |
|---|---|---|---|---|---|---|---|---|---|
| Pressure | | | | | | | | | |
| bar abs | 8 | 6 | 6 | 36 | 1.5 | 1.5 | 10 | 8 | 8 |
| kPa | 800 | 600 | 600 | 3600 | 150 | 150 | 1000 | 800 | 800 |
| Temperature deg C. | −171 | −172 | 23 | 32 | 23 | 23 | −169 | −173 | −171 |
| Flowrate kgm/h | 4810 | 1830 | 5880 | 1060 | 80 | 100 | 20 | 40 | 20 |
| Hydrogen mol % | 0.0 | 0.0 | 0.0 | 0.0 | 0.3 | 12.5 | 0.0 | 0.5 | 0.0 |
| Nitrogen mol % | 0.5 | 0.5 | 0.5 | 0.5 | 43.0 | 1.4 | 100 | 81.7 | 42.7 |
| Carbon monoxide mol % | 99.0 | 99.0 | 99.0 | 99.0 | 25.1 | 84.4 | 0.0 | 17.8 | 57.3 |
| Argon mol % | 0.5 | 0.5 | 0.5 | 0.5 | 23.1 | 1.5 | 0.0 | 0.0 | 0.0 |
| Methane mol % | 0.0 | 0.0 | 0.0 | 0.0 | 8.5 | 0.2 | 0.0 | 0.0 | 0.0 |
| Vapor fraction | 0 | 1 | 1 | 1 | 1 | 1 | 0 | 1 | 0 |

As can be seen by comparison of Tables 1 and 2, the provision of column 51 significantly increases the pressure (31 Bara (3100 kPa) for the FIG. 3 process compared with 59 Bara (5900 kPa) for the FIG. 4 process) of the hydrogen-rich product at substantially the same carbon monoxide product purity and yield. There is a decrease (about 15%) in the CO lost with the fuel gas product but an increase (about 35%) in the CO lost with the hydrogen product. Further, the volume of recycle stream is more than doubled and is at a slightly lower pressure requiring the use of a larger recycle compressor 23. However, the increased capital cost and energy requirement of the larger recycle compressor are small compared with the savings in obviating the requirement of compression of the hydrogen product to a suitable working pressure for downstream processing.

Numerous modifications and variations can be made to the embodiment of FIG. 4 without departing from the scope and spirit of present invention. For example, a portion of the feed to distillation column 32 from column 26 could be retained as liquid optionally subcooled in heat exchanger 5 and reduced in pressure to feed the column a few equilibrium stages above the remainder of the feed which has been vaporized in heat exchanger 5. Also, a vapor portion could be separated after the pressure reduction in control valve 31 and introduced into column 32 a few equilibrium stages above the feed vaporized in heat exchanger 5.

In both of the processes of FIGS. 3 and 4, distillation energy for the process is provided by a carbon monoxide heat pump system with direct reflux of the methane-separation column 32. This is convenient when the heat pump system is integrated with product carbon monoxide compression. In cases where the product compression is separate, or only low pressure carbon monoxide is required, the heat pump duty could be supplied by some other heat pump fluid, such as nitrogen, by adding a condenser to column 32 to provide reflux by indirect heat exchange. In the case of a nitrogen heat pump, the liquid nitrogen described in FIG. 4 could be provided from the heat pump system and refrigeration provided by a hydrogen, carbon monoxide or nitrogen expander or auxiliary liquid nitrogen.

Reboiler duties for columns 26 and 32 can be accomplished in separate reboiler heat exchangers instead of in heat exchanger 5 by, for example, indirect heat exchange with the recycle heat pump stream alone.

Product carbon monoxide 33 in both of the processes of FIGS. 3 and 4 is delivered from the top of the methane-separation column 32 and reflux 37 to that column is provided by direct introduction of a liquefied portion 37 of the carbon monoxide heat pump stream 39, as is conventional for a methane-separation column in a partial condensation cold box.

Figure 5:
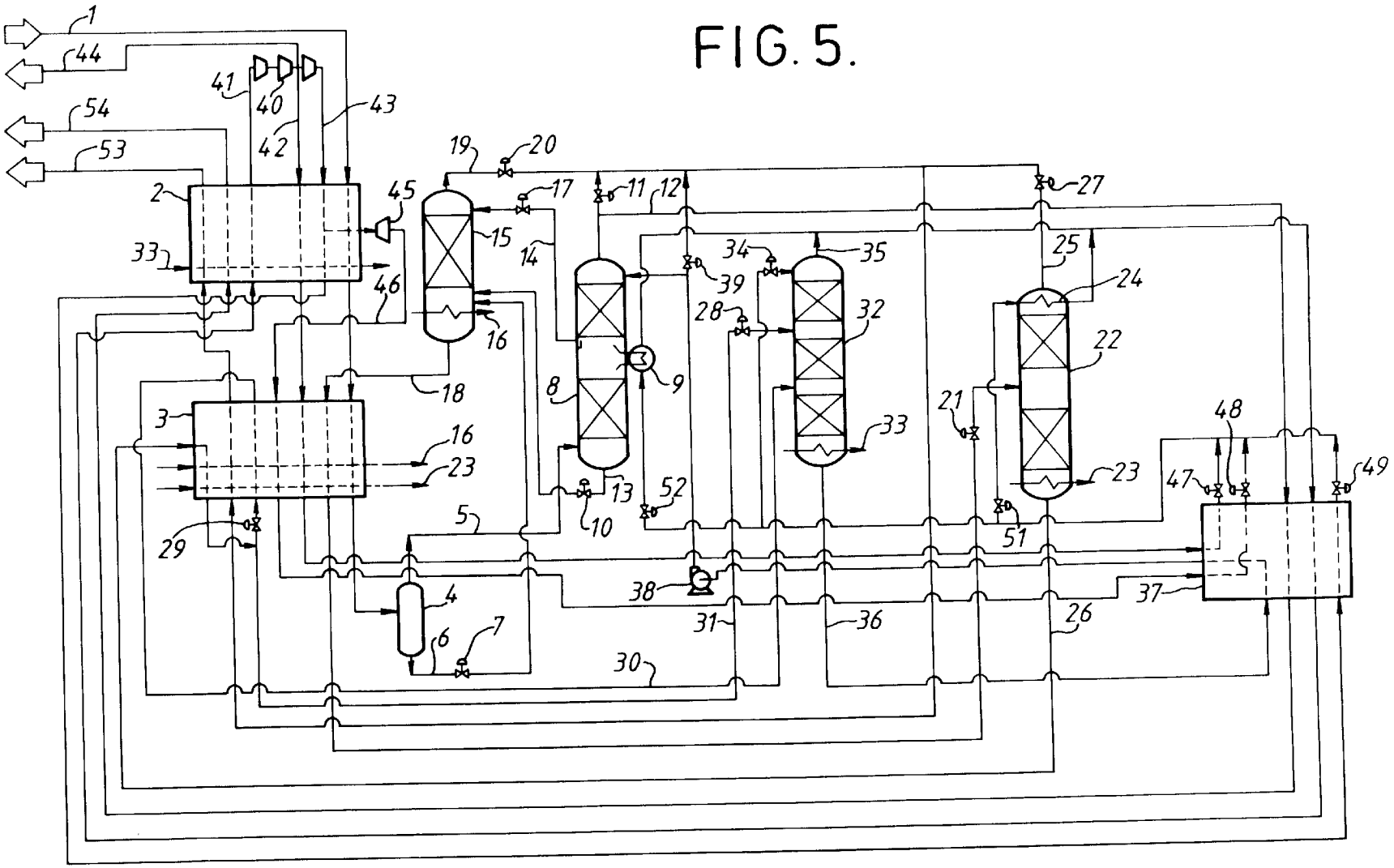
FIG. 5 is a schematic representation of a process for separating carbon monoxide from a synthesis gas containing carbon monoxide, hydrogen, methane and nitrogen in accordance with another preferred embodiment of the process of our co-pending U.S. patent application Ser. No. 09/224,690 filed Jan. 4, 1999

Referring now to FIG. 5, crude synthesis gas is introduced via conduit 1, cooled in heat exchanger 2, and further cooled and partially condensed in heat exchanger 3. The partially condensed mixture is separated in separator 4 to provide vapor and liquid fractions in conduits 5 and 6 respectively. The vapor in conduit 5 is fed to a methane wash column 8 where it is washed with liquid methane to dissolve the carbon monoxide into a CO-loaded bottoms liquid which is removed in conduit 13. Heat exchanger 9 removes the heat of solution of carbon monoxide in methane from the column.

Overheads vapor from the methane wash column 8 is removed in conduit 12, warmed in heat exchangers 37, and 2, and leaves the plant as hydrogen rich product in conduit 54. This may be further processed, for example in a pressure swing adsorber, to provide a pure hydrogen product. Excess hydrogen from column 8 is reduced in pressure by control valve 11 and mixed with other streams as described below to provide fuel gas 53.

Bottoms liquid in conduit 13 is reduced in pressure by control valve 10, and introduced into hydrogen stripping column 15. The liquid fraction in conduit 6 from the feed separator 4 is reduced in pressure by control valve 7 and also introduced into column 15. Although these feeds to column 15 are shown to be below the section containing trays or packing, it is preferred that they will be a few stages above the bottom of the section. Reboiler 16 at the bottom of column 15 provides stripping vapor for the liquid whereby hydrogen is stripped out as the vapor passes over trays or packing in column 15. Reboiler duty is accomplished by indirect heat exchange with a CO recycle heat pump stream and the feed gas mixture. This is accomplished in heat exchanger 3 but may be performed in a separate reboiler heat exchanger. Liquid methane in conduit 14 from an intermediate location of methane wash column 8 is reduced in pressure by control valve 17 and provides reflux for the column 15.

Hydrogen-stripped CO-loaded methane is removed as bottoms liquid from hydrogen stripping column 15 in conduit 18, subcooled in heat exchanger 3, reduced in pressure by control valve 21, and introduced into nitrogen-separation fractionation column 22. This liquid feed is separated in column 22 into a nitrogen-containing overheads vapor removed in conduit 25, and a nitrogen-freed CO-loaded methane bottoms liquid removed in conduit 26. Column 22 is reboiled by bottom reboiler 23 and reflux is provided by top condenser 24. Reboiler duty is accomplished by indirect heat exchange with the CO recycle heat pump stream and the feed gas mixture. This is accomplished in heat exchanger 3 but may be performed in a separate reboiler heat exchanger.

Bottoms liquid in conduit 26 is subcooled in heat exchanger 3 and split into two fractions. The first fraction in conduit 31 is reduced in pressure by control valve 28 and fed to methane-separation fractionation column 32. The second fraction is reduced in pressure by control valve 29, partially vaporized in heat exchanger 3, and introduced via conduit 30 into methane-separation column 32 several stages below the first liquid fraction. These feeds are separated in column 32 into CO product overheads vapor removed in conduit 35 and methane bottoms liquid removed in conduit 36. Column 32 is reboiled by bottom reboiler 33 and reflux is provided by direct introduction of liquid carbon monoxide via control valve 34. Reboiler duty is accomplished by indirect heat exchange with the CO recycle heat pump stream and the feed gas mixture. This is accomplished in heat exchanger 2 but may be performed in a separate reboiler heat exchanger.

Bottoms liquid in conduit 36 is subcooled in heat exchanger 37, pumped to higher pressure in pump 38, and fed as methane reflux to methane wash column 8. Any excess bottoms liquid is reduced in pressure through control valve 39, combined with other fuel streams, warmed in heat exchangers 3 and 2, and removed from the plant as low pressure fuel in conduit 53.

The CO recycle heat pump stream is provided from multistage compressor 40 via conduits 42 and 43. Intermediate pressure CO stream in conduit 42 is cooled in heat exchanger 2, further cooled and condensed in heat exchanger 3, and subcooled in heat exchanger 37. High pressure CO stream in conduit 43 is partially cooled in heat exchanger 2 and split into two substreams. The first substream is expanded to an intermediate pressure in expander 45 and sent via conduit 46 to heat exchanger 3 for further cooling and condensing, and subcooled in heat exchanger 37. The second substream is further cooled and condensed in heat exchanger 2, and subcooled in heat exchanger 37. The three subcooled condensed heat pump streams from heat exchanger 37 are reduced in pressure by control valves 47, 48, and 49 respectively and combined to provide reflux for methane-separation column 32 and condenser duty for nitrogen-separation column 22 by indirect heat exchange in condenser 24, and to remove the heat of solution from methane wash column 8. Vaporized CO heat pump streams from condenser 24 and heat exchanger 9 are mixed with the CO product vapor overheads in conduit 35. The combined stream is warmed in heat exchangers 37 and 2, and delivered via conduit 41 to the suction side of compressor 40. A portion of the compressed stream is withdrawn from an intermediate stage of compressor 40 to provide a CO product stream which is delivered via conduit 44. The remainder of the compressed stream is recycled via conduits 42 and 43 as described above.

Hydrogen-enriched overheads vapor in conduit 19 from hydrogen stripping column 15 and nitrogen-containing overheads vapor in conduit 25 from nitrogen-separation column 22 are reduced in pressure by control valves 20 and 27 respectively, mixed with the excess hydrogen from wash column 8 and the excess methane bottoms liquid from methane-separation column 32, vaporized in heat exchanger 3, then warmed in heat exchanger 2 to be delivered as fuel gas in conduit 53.

Table 3 summarizes a mass balance for a typical application of the embodiment of FIG. 5.

TABLE 3

(FIG. 5)

(Part 1 of 3)

| Stream | 1 | 5 | 6 | 12 | 13 | 14 | 18 |
|---|---|---|---|---|---|---|---|
| Pressure | | | | | | | |
| bar abs | 22 | 21 | 21 | 21 | 21 | 21 | 11 |
| kPa | 2200 | 2100 | 2100 | 2100 | 2100 | 2100 | 1100 |

TABLE 3-continued (FIG. 5)

| | | | | | | | |
|---|---|---|---|---|---|---|---|
| Temperature deg C. | 10 | −167 | −167 | −170 | −169 | −178 | −147 |
| Flowrate kgm/h | 1270 | 1230 | 40 | 1010 | 580 | 40 | 650 |
| Hydrogen mol % | 78.4 | 80.9 | 2.2 | 96.0 | 2.4 | 1.8 | 0.1 |
| Nitrogen mol % | 0.8 | 0.8 | 0.8 | 0.3 | 1.2 | 1.0 | 1.2 |
| Carbon monoxide mol % | 15.0 | 14.7 | 24.8 | 0.5 | 30.0 | 7.2 | 28.8 |
| Methane mol % | 5.7 | 3.5 | 72.1 | 3.2 | 66.4 | 90.0 | 69.9 |
| Vapor fraction | 1 | 1 | 0 | 1 | 0 | 0 | 0 |

(Part 2 of 3)

| Stream | 19 | 25 | 26 | 30 | 31 | 35 | 36 |
|---|---|---|---|---|---|---|---|
| Pressure | | | | | | | |
| bar abs | 11 | 4 | 5 | 3 | 5 | 3 | 3 |
| kPa | 1100 | 400 | 500 | 300 | 500 | 300 | 300 |
| Temperature deg C. | −174 | −180 | −161 | −161 | −167 | −182 | −147 |
| Flowrate kgm/h | 20 | 10 | 640 | 320 | 310 | 180 | 450 |
| Hydrogen mol % | 88.5 | 6.4 | 0.0 | 0.0 | 0.0 | 0.0 | 0.0 |
| Nitrogen mol % | 1.9 | 58.4 | 0.0 | 0.0 | 0.0 | 0.1 | 0.0 |
| Carbon monoxide mol % | 6.3 | 35.3 | 28.7 | 28.7 | 28.7 | 99.9 | 0.3 |
| Methane mol % | 3.3 | 0.0 | 71.3 | 71.3 | 71.3 | 0.0 | 99.7 |
| Vapor fraction | 1 | 1 | 0 | 0.3 | 0 | 1 | 0 |

(Part 3 of 3)

| Stream | 41 | 42 | 43 | 44 | 46 | 53 | 54 |
|---|---|---|---|---|---|---|---|
| Pressure | | | | | | | |
| bar abs | 3 | 13 | 27 | 13 | 10 | 2 | 21 |
| kPa | 300 | 1300 | 2700 | 1300 | 1000 | 200 | 2100 |
| Temperature deg C. | 18 | 39 | 39 | 39 | −142 | 18 | 18 |
| Flowrate kgm/h | 900 | 230 | 500 | 180 | 190 | 80 | 1010 |
| Hydrogen mol % | 0.0 | 0.0 | 0.0 | 0.0 | 00 | 34.6 | 96.1 |
| Nitrogen mol % | 0.1 | 0.1 | 0.1 | 0.1 | 0.1 | 9.2 | 0.3 |
| Carbon monoxide mol % | 99.9 | 99.9 | 99.9 | 99.9 | 99.9 | 6.8 | 0.5 |
| Methane mol % | 0.0 | 0.0 | 0.0 | 0.0 | 0.0 | 49.4 | 3.2 |
| Vapor fraction | 1 | 1 | 1 | 1 | 1 | 1 | 1 |

Figure 6:
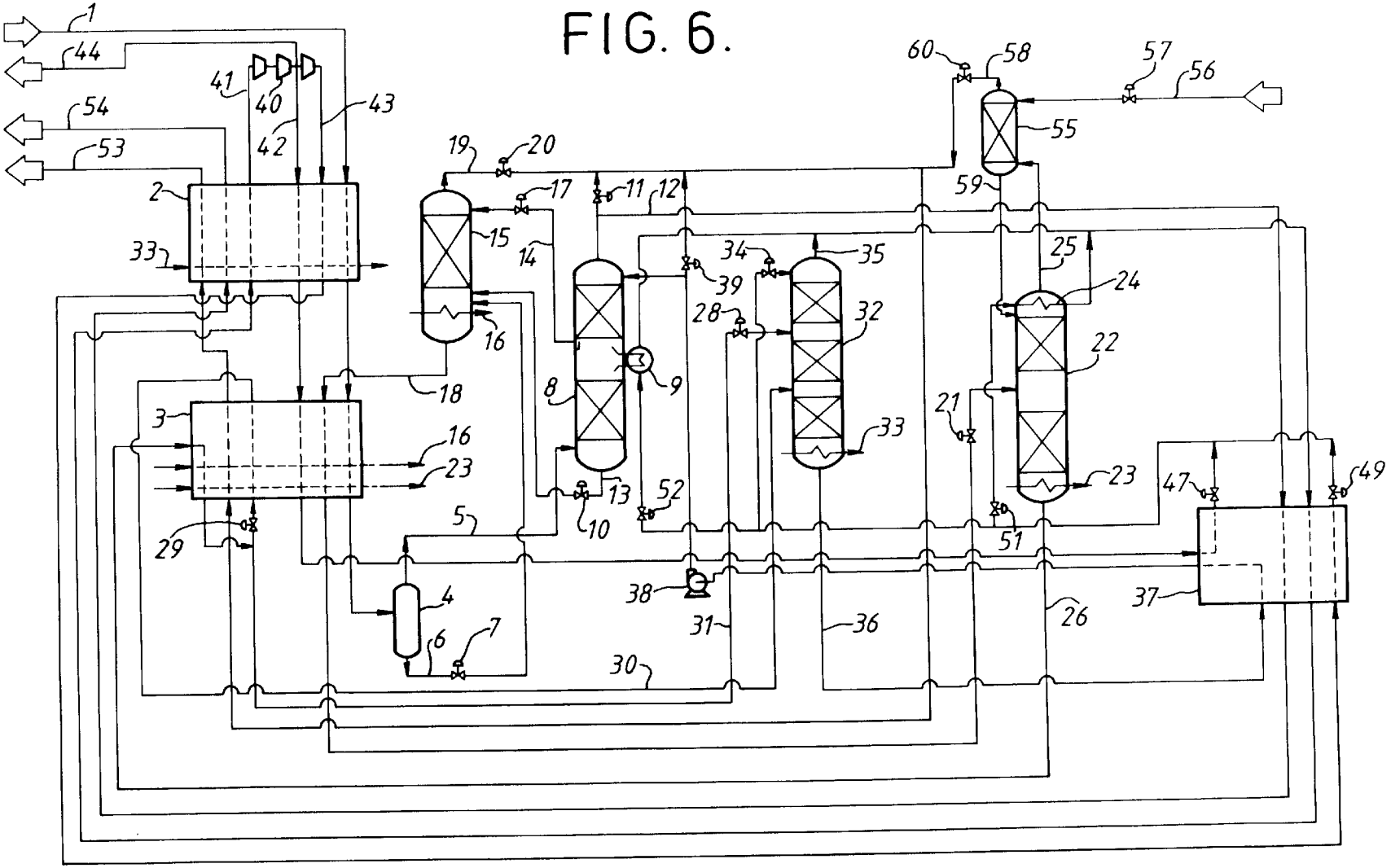
FIG. 6 is a schematic representation of a modification of the process of FIG. 5 incorporating a liquid nitrogen-wash column in accordance with the present invention.

FIG. 6 illustrates an embodiment of the invention which is derived from the process of FIG. 5 and is particularly beneficial when only a small amount of external refrigeration is required for the process. Features common with the embodiment of FIG. 5 are identified by the same reference numerals and only the differences between the two embodiments will be described.

The CO recycle stream expander 45 of FIG. 5 is omitted and the entire CO high pressure stream 43 from compressor 41 is cooled and condensed in heat exchanger 2, subcooled in heat exchanger 37 and reduced in pressure through valve 49.

The nitrogen-containing overheads vapor in conduit 25 from the nitrogen-separation column 22 is introduced into column 55, which is refluxed with liquid nitrogen introduced via conduit 56 and control valve 57. Bottoms liquid is returned via conduit 50 to the nitrogen-separation column 22 and overheads vapor is mixed with the other streams providing fuel gas 53. The provision of column 55 not only provides the refrigeration requirement provided by expander 45 in FIG. 5 but also recovers carbon monoxide from the nitrogen-containing overheads vapor as it rises through the trays or packing of the column 55.

Table 4 summarizes a mass balance for a typical application of the embodiment of FIG. 6.

TABLE 4

(FIG. 6)

(Part 1 of 3)

| Stream | 1 | 5 | 6 | 12 | 13 | 14 | 18 | 19 |
|---|---|---|---|---|---|---|---|---|
| Pressure | | | | | | | | |
| bar abs | 22 | 21 | 21 | 21 | 21 | 21 | 12 | 12 |
| kPa | 2200 | 2100 | 2100 | 2100 | 2100 | 2100 | 1200 | 1200 |
| Temperature deg C. | 10 | −167 | −167 | −171 | −170 | −178 | −148 | −176 |
| Flowrate kgm/h | 1270 | 1230 | 40 | 1020 | 510 | 40 | 580 | 10 |
| Hydrogen mol % | 78.4 | 81.2 | 2.3 | 95.8 | 2.4 | 1.8 | 0.2 | 90.0 |
| Nitrogen mol % | 0.8 | 0.8 | 0.9 | 0.3 | 1.3 | 1.1 | 1.2 | 1.4 |
| Carbon monoxide mol % | 15.0 | 14.7 | 25.5 | 0.9 | 33.0 | 10.1 | 31.6 | 6.5 |
| Methane mol % | 5.7 | 3.4 | 71.4 | 3.0 | 63.3 | 87.0 | 67.0 | 2.4 |
| Vapor fraction | 1 | 1 | 0 | 1 | 0 | 0 | 0 | 1 |

(Part 2 of 3)

| Stream | 25 | 26 | 30 | 31 | 35 | 36 | 41 | 42 |
|---|---|---|---|---|---|---|---|---|
| Pressure | | | | | | | | |
| bar abs | 5 | 5 | 3 | 5 | 3 | 3 | 3 | 13 |
| kPa | 500 | 500 | 300 | 500 | 0300 | 300 | 300 | 1300 |
| Temperature deg C. | −180 | −162 | −148 | −167 | −182 | −147 | 18 | 39 |
| Flowrate kgm/h | 30 | 570 | 100 | 470 | 180 | 390 | 900 | 460 |
| Hydrogen mol % | 5.5 | 0.0 | 0.0 | 0.0 | 0.0 | 0.0 | 0.0 | 0.0 |
| Nitrogen mol % | 75.0 | 0.0 | 0.0 | 0.0 | 0.1 | 0.0 | 0.1 | 0.1 |
| Carbon monoxide mol % | 19.5 | 31.9 | 31.9 | 31.9 | 99.9 | 0.3 | 99.9 | 99.9 |
| Methane mol % | 0.0 | 68.0 | 68.0 | 68.0 | 0.0 | 99.7 | 0.0 | 0.0 |
| Vapor fraction | 1 | 0 | 1 | 0 | 1 | 0 | 1 | 1 |

(Part 3 of 3)

| Stream | 43 | 44 | 53 | 54 | 56 | 58 | 59 |
|---|---|---|---|---|---|---|---|
| Pressure | | | | | | | |
| bar abs | 27 | 13 | 2 | 21 | 5 | 5 | 5 |
| kPa | 2700 | 1300 | 200 | 2100 | 500 | 500 | 500 |
| Temperature deg C. | 39 | 39 | 18 | 18 | −180 | −181 | −181 |
| Flowrate kgm/h | 260 | 180 | 100 | 1020 | 20 | 30 | 20 |
| Hydrogen mol % | 0.0 | 0.0 | 28.6 | 95.8 | 0.0 | 5.4 | 0.0 |
| Nitrogen mol % | 0.1 | 0.1 | 25.0 | 0.3 | 100.0 | 91.1 | 75.2 |
| Carbon monoxide mol % | 99.9 | 99.9 | 2.2 | 0.9 | 0.0 | 3.6 | 24.7 |
| Methane mol % | 0.0 | 0.0 | 44.2 | 3.0 | 0.0 | 0.0 | 0.0 |
| Vapor fraction | 1 | 1 | 1 | 1 | 0 | 1 | 0 |

As can be seen by comparison of Tables 3 and 4, the provision of column 55 reduces by about half the proportion (69% for the FIG. 5 process compared with 36% for the FIG. 6 process) of recycle carbon monoxide which is compressed from intermediate pressure (13 Bara; 130 kPa) to high pressure (27 Bara; 270 kPa) in the CO heat pump compressor 40 without loss of CO purity or yield.

Numerous modifications and variations can be made to the embodiment of FIG. 6 without departing from the scope and spirit of present invention. For example, the bottoms liquid from nitrogen-separation column 22 could be divided without any subcooling to provide a saturated liquid portion, which is reduced in pressure and fed to methane-separation column 32 a few equilibrium stages above the remainder of said bottoms liquid, which is at least partially vaporized in heat exchanger 3.

Distillation energy for the process of FIGS. 5 and 6 is provided by the carbon monoxide heat pump system, and direct reflux of methane-separation column 32. This is convenient when the heat pump system is integrated with product carbon monoxide compression. In cases where the product compressor is separate, or only low pressure carbon monoxide is required, the heat pump duty could be supplied by some other heat pump fluid, such as nitrogen, by adding a condenser to column 32 to provide reflux by indirect heat exchange. In the case of a nitrogen heat pump, the liquid nitrogen described in FIG. 6 could be provided from the heat pump system and refrigeration provided by a hydrogen, carbon monoxide, or nitrogen expander.

Reboiler duties for nitrogen-separation and methane-separation columns 22 and 32 can be accomplished in separate reboiler heat exchangers by indirect heat exchange with the recycle carbon monoxide heat pump streams alone.

It will be appreciated that the invention is not restricted to the particular embodiments and modifications described above and that numerous modifications and variations can be made without departing from the scope of the invention.

What we claim is:

1. In a cryogenic process for separating carbon monoxide from a gaseous mixture containing carbon monoxide and hydrogen and contaminated with nitrogen comprising separating hydrogen and carbon monoxide contents to provide a carbon monoxide-enriched nitrogen-containing stream and separating carbon monoxide and nitrogen contents of said stream in a nitrogen-distillation column to provide a nitrogen-enriched overheads vapor and a nitrogen-freed bottoms liquid, the improvement consisting in that said overheads vapor is washed with liquid nitrogen to remove carbon monoxide therefrom and the resultant carbon monoxide-enriched liquid nitrogen returned to said column to contribute to reflux thereof.

2. The process claimed in claim 1, wherein said separation of hydrogen and carbon monoxide contents comprises partially condensing the gaseous mixture to provide a hydrogen-enriched vapor feed fraction and a carbon monoxide-enriched liquid feed fraction.

3. The process claimed in claim 2, wherein hydrogen is stripped from the carbon monoxide-enriched liquid feed fraction to provide a hydrogen-rich vapor fraction and a hydrogen-freed liquid fraction.

4. The process claimed in claim 3, wherein the hydrogen-enriched vapor feed fraction is partially condensed by heat exchange against one or more process streams and at least a portion of the resultant condensed vapor feed fed to the hydrogen stripping step to augment the carbon monoxide-enriched liquid feed fraction.

5. The process claimed in claim 3, wherein the hydrogen-enriched vapor feed fraction is partially condensed by heat exchange against one or more process streams and at least a portion of the resultant condensed vapor feed is recycled to the partial condensation step.

6. The process claimed in claim 3, wherein the hydrogen-enriched vapor feed portion is washed with liquid methane to remove carbon monoxide therefrom to form a carbon monoxide-enriched liquid methane which is fed to the hydrogen stripping step to augment the carbon monoxide-enriched liquid feed fraction.

7. The process claimed in claim 1, wherein the gaseous mixture contains methane and, before or after said nitrogen distillation, methane and carbon monoxide contents are separated in a distillation column to provide methane-enriched liquid bottoms and methane-freed carbon monoxide overheads vapor.

8. A cryogenic process for separating carbon monoxide from a gaseous mixture containing carbon monoxide, hydrogen and methane and contaminated with nitrogen, comprising the steps of:

partially condensing the gaseous mixture to provide a hydrogen-enriched vapor feed fraction and a carbon monoxide-enriched liquid feed fraction;

stripping hydrogen from the carbon monoxide-enriched liquid feed fraction to provide a hydrogen-rich vapor fraction and a hydrogen-freed liquid fraction;

separating methane and carbon monoxide contents of said hydrogen-freed liquid fraction in a distillation column to provide methane-enriched bottoms liquid and methane-freed carbon monoxide overheads vapor;

separating nitrogen and carbon monoxide contents of said hydrogen-freed liquid fraction in a distillation column to provide nitrogen-freed carbon monoxide bottoms liquid and nitrogen-enriched overheads vapor;

washing said nitrogen-enriched overheads vapor with liquid nitrogen to remove carbon monoxide therefrom and thereby provide carbon monoxide-enriched liquid nitrogen; and returning said carbon monoxide-enriched liquid nitrogen to the nitrogen-separation column as reflux.

9. The process claimed in claim 8, wherein the hydrogen-enriched vapor feed portion is washed with liquid methane to remove carbon monoxide therefrom to form a carbon monoxide-enriched liquid methane which is fed to the hydrogen stripping step to augment the carbon monoxide-enriched liquid feed fraction.

10. A cryogenic process, for separating carbon monoxide from a gaseous mixture containing carbon monoxide, hydrogen and methane and contaminated with nitrogen, comprising the steps of:

partially condensing the gaseous mixture to provide a hydrogen-enriched vapor feed fraction and a carbon monoxide-enriched liquid feed fraction;

stripping hydrogen from the carbon monoxide-enriched liquid feed fraction to provide a hydrogen-rich vapor fraction and a hydrogen-freed liquid fraction;

separating nitrogen and carbon monoxide contents of said hydrogen-freed liquid fraction in a distillation column to provide nitrogen-freed carbon monoxide bottoms liquid and nitrogen-enriched overheads vapor;

washing said nitrogen-enriched overheads vapor with liquid nitrogen to remove carbon monoxide therefrom and thereby provide carbon monoxide-enriched liquid nitrogen;

returning said carbon monoxide-enriched liquid nitrogen to the nitrogen-separation column as reflux; and separating the methane and carbon monoxide contents of said nitrogen-freed carbon monoxide bottoms liquid.

11. The process claimed in claim 10, wherein the hydrogen-enriched vapor feed portion is washed with liquid methane to remove carbon monoxide therefrom to form a carbon monoxide-enriched liquid methane which is fed to the hydrogen stripping step to augment the carbon monoxide-enriched liquid feed fraction.

12. An apparatus for separating carbon monoxide from a gaseous mixture containing carbon monoxide and hydrogen and contaminated with nitrogen, said apparatus comprising:

a separator constructed and arranged to separate hydrogen and carbon monoxide contents to provides a carbon monoxide-enriched nitrogen-containing stream;

a nitrogen-distillation column constructed and arranged to separate nitrogen content from carbon monoxide content of said stream to provide a nitrogen-enriched overheads vapor and a nitrogen-freed bottoms liquid;

a wash column;

a conduit constructed and arranged to feed said overheads vapor to the wash column;

a conduit constructed and arranged to feed liquid nitrogen to the wash column to wash carbon monoxide from said vapor and thereby provide carbon monoxide-enriched liquid nitrogen; and a conduit constructed and arranged to feed said carbon monoxide-enriched liquid nitrogen to the nitrogen-separation column as additional reflux.

13. An apparatus for separating carbon monoxide from a gaseous mixture containing carbon monoxide and hydrogen and contaminated with nitrogen, said apparatus comprising a heat exchanger constructed and arranged to partially condense the gaseous mixture to provide a hydrogen-enriched vapor feed fraction and a carbon monoxide-enriched liquid feed fraction;

a distillation column constructed and arranged to separate nitrogen and carbon monoxide contents of said liquid feed fraction to provide nitrogen-freed carbon monoxide bottoms liquid and nitrogen-enriched overheads vapor;

a distillation column constructed and arranged to separate methane and carbon monoxide contents of said liquid feed fraction to provide methane-enriched bottoms liquid and methane-freed carbon monoxide overheads vapor, said methane-separation column being upstream or downstream of said nitrogen-separation column;

a wash column;

a conduit constructed and arranged to feed said nitrogen-enriched overheads vapor to the wash column;

a conduit constructed and arranged to feed liquid nitrogen to the wash column to wash carbon monoxide from said vapor and thereby provide carbon monoxide-enriched liquid nitrogen; and a conduit constructed and arranged to feed said carbon monoxide-enriched liquid nitrogen to the nitrogen-separation column as additional reflux.

14. The apparatus claimed in claim 13, further comprising a stripping column constructed and arranged to remove hydrogen from the carbon monoxide-enriched liquid feed fraction to provide a hydrogen-freed liquid fraction for feeding to one of the nitrogen-distillation and methane-distillation columns and a hydrogen-rich vapor fraction.

15. The apparatus claimed in claim 14, further comprising a heat exchanger constructed and arranged to partially condense the hydrogen-enriched vapor feed fraction by heat exchange against one or more process streams and a conduit constructed and arranged to feed at least a portion of the resultant condensed vapor feed to the hydrogen stripping column to augment the carbon monoxide-enriched liquid feed fraction.

16. An apparatus as claimed in claim 14, further comprising a heat exchanger constructed and arranged to partially condense the hydrogen-enriched vapor feed fraction by heat exchange against one or more process streams and a conduit constructed and arranged to recycle at least a portion of the resultant condensed vapor feed to the partial condensation step.

17. The apparatus claimed in claim 14, further comprising a liquid methane wash column constructed and arranged to wash the hydrogen-enriched vapor feed portion with liquid methane to remove carbon monoxide therefrom to form a carbon monoxide-enriched liquid methane and a conduit constructed and arranged to feed said carbon monoxide-enriched liquid methane to the hydrogen stripping column to augment the carbon monoxide-enriched liquid feed fraction.

18. The apparatus claimed in claim 13, wherein said nitrogen distillation column is located downstream of said methane separation and separates the nitrogen and carbon monoxide contents of said methane-freed carbon monoxide overheads vapor.

19. The apparatus claimed in claim 13, wherein said methane distillation column is located downstream of said nitrogen distillation and separates the methane and carbon monoxide contents of said nitrogen-freed carbon monoxide bottoms liquid.

* * * * *